United States Patent [19]

Dohnomoto et al.

[11] Patent Number: 4,656,100

[45] Date of Patent: Apr. 7, 1987

[54] FIBER REINFORCED MATERIAL WITH MATRIX METAL CONTAINING COPPER AND REINFORCING FIBERS CONTAINING ALUMINA

[75] Inventors: Tadashi Dohnomoto; Yoshitaka Takahashi, both of Toyota, Japan

[73] Assignee: Toyota Jidosha Kabushiki Kaisha, Toyota, Japan

[21] Appl. No.: 723,759

[22] Filed: Apr. 16, 1985

[30] Foreign Application Priority Data

Jun. 20, 1984 [JP] Japan ..... 59-127127

[51] Int. Cl.[4] ..... H01F 1/00

[52] U.S. Cl. ..... 428/611; 428/614; 428/929; 420/489

[58] Field of Search ..... 428/611, 929, 614; 420/489, 590; 148/411, 436

[56] References Cited

U.S. PATENT DOCUMENTS

| | | | |
|---|---|---|---|
| 3,084,421 | 4/1963 | McDanels et al. | 428/611 |
| 3,218,697 | 11/1965 | Wainer | 428/611 |
| 3,663,356 | 5/1972 | Li | 428/611 |
| 3,940,262 | 2/1976 | Niebylski | 428/611 |
| 4,294,616 | 10/1981 | Kim et al. | 75/234 |
| 4,452,865 | 6/1984 | Yamatsuta et al. | 428/614 |
| 4,465,741 | 8/1984 | Yamatsuta et al. | 420/590 |

FOREIGN PATENT DOCUMENTS

| | | | |
|---|---|---|---|
| 45002 | 2/1982 | European Pat. Off. | 428/611 |
| 10763 | 3/1971 | Japan | 420/590 |
| 377428 | 7/1973 | U.S.S.R. | 420/489 |

OTHER PUBLICATIONS

Graham R. L. et al. "Dispersion-Hardened Copper and Copper Alloys Made from Chemically Prepared Powders" J. of Inst. of Metals, vol. 99 1971, pp. 81-92.

*Primary Examiner*—Christopher W. Brody
*Attorney, Agent, or Firm*—Oblon, Fisher, Spivak, McClelland & Maier

[57] ABSTRACT

This composite material is composed essentially of a matrix metal which is copper or an alloy thereof, and a reinforcing fiber material which is a collection of alumina - silica type short fibers in which the included amount of alumina is about 40% by weight or more, with the total amount of non fibrous particles included in the collection of fibers being less than or equal to about 7% by weight, with the total amount of non fibrous particles with diameter greater than or equal to about 150 microns included in the collection of fibers being less than or equal to about 1% by weight, and with the volume proportion of the short fiber material being from about 0.5% to about 30%. Optionally and preferably, this volume proportion of short fiber material is from about 1.0% to about 25%, or from about 0.5% to about 10%, or even better from about 1.0% to about 5%. And the total amount of non fibrous particles can be less than or equal to about 4% by weight; and the total amount of non fibrous particles with diameter greater than or equal to about 150 microns can be less than or equal to about 0.6% by weight. The reinforcing fiber material can be fibers containing a substantial amount of silica, or alternatively can be a fiber material substantially made only of alumina; and may contain a substantial amount of, or consist substantially only of, alpha alumina. The matrix material may be pure copper, brass, or bronze.

13 Claims, 6 Drawing Figures

FIBER REINFORCED MATERIAL WITH MATRIX METAL CONTAINING COPPER AND REINFORCING FIBERS CONTAINING ALUMINA

BACKGROUND OF THE INVENTION

The present invention relates to a fiber reinforced material, and in particular to a fiber reinforced material in which the matrix metal is copper or a copper alloy and the reinforcing material is alumina-silica type fibers containing at least a certain amount of alumina, said fiber reinforced material being particularly suitable for use as a material for forming electrical contacts and the like.

Because of their excellent sliding characteristics and excellent electrical conductivity, pure copper and alloys of copper have long been valued for use for manufacturing sliding members and electrical contact members. However, copper and conventionally known copper alloys, when used for manufacturing sliding members to be utilized under conditions of high stress, are often inadequate in wear resistance and anti burning resistance. With the object of improving the wear resistance of a member which is in sliding contact with another member and is also used for conducting an electrical current, such as for example an electrical current supplying brush type member or a welding tip, it has in the past been practiced to add various elements to alloy with pure copper; but although the wear resistance and the anti burning resistance qualities of the material can thereby be improved, concurrently the electrical conductivity of the material is deteriorated; and therefore it is very difficult to maintain both the wear resistance and the anti burning resistance qualities of the material and also its electrical conductivity at a high level, in order to provide a superior material for making electrical contact members and the like.

SUMMARY OF THE INVENTION

The inventors of the present invention have considered the problems outlined above with respect to pure copper and copper alloys as used for manufacture of sliding members and electrical contact members and so on, and have undertaken various experimental researches in this connection some of which will be detailed later in this specification, as a result of which they have discovered the advantage of reinforcing a matrix metal such as copper or a copper alloy with a reinforcing material which is a fiber material containing alumina, and they have further discovered the necessity of maintaining such values as the volume proportion of the alumina containing fibers and the total amount of non fibrous particles inevitably included therein within certain prescribed limits.

Accordingly, it is the primary object of the present invention to provide a composite material which overcomes the above outlined disadvantages.

It is a further object of the present invention to provide such a composite material which has very good sliding characteristics.

It is a further object of the present invention to provide such a composite material which has good electrical conductivity.

It is a further object of the present invention to provide such a composite material which has an electrical conductivity substantially equal to that of copper and alloys of copper.

It is a further object of the present invention to provide such a composite material which has good characteristics with regard to wear on a member made of the material itself, during frictional wear against another member.

It is a further object of the present invention to provide such a composite material which has good characteristics with regard to wear on a cooperating member, during such frictional wear of a member made from said composite material against said cooperating member.

It is a further object of the present invention to provide such a composite material which is not particularly liable to scuffing of a member made of the material itself, during frictional wear against another member.

It is a further object of the present invention to provide such a composite material which is not particularly liable to scuffing of a cooperating member, during such frictional wear of a member made from said composite material against said cooperating member.

It is a yet further object of the present invention to provide such a composite material which has good machinability.

It is a further object of the present invention to provide such a composite material which has good anti burning characteristics.

It is a yet further object of the present invention to provide such a composite material which is suitable for manufacturing electrical contact members.

It is a yet further object of the present invention to provide such a composite material which is suitable for manufacturing electrical contact members which are to be required to function in extreme conditions.

It is a yet further object of the present invention to provide such a composite material which is suitable for the manufacture of welding tips.

According to the most general aspect of the present invention, these and other objects are accomplished by a composite material composed essentially of a matrix metal which is copper or an alloy thereof, and a reinforcing fiber material which is a collection of alumina-silica type short fibers in which the included amount of alumina is about 40% by weight or more, with the total amount of non fibrous particles included in said collection of fibers being less than or equal to about 7% by weight, with the total amount of non fibrous particles with diameter greater than or equal to about 150 microns included in said collection of fibers being less than or equal to about 1% by weight, and with the volume proportion of said short fiber material being from about 0.5% to about 30%.

According to such a material, as will become apparent from the details of the experimental researches made by the present inventors which are described hereinafter, the disadvantages outlined above with respect to the prior art are overcome, and there is provided a composite material which has very good sliding characteristics, and which has good electrical conductivity, which can be substantially equal to that of copper and alloys of copper. This composite material has good characteristics with regard to wear on a member made of the material itself, during frictional wear against another cooperating member, and also has good characteristics with regard to wear on said cooperating member. Further, this composite material is not particularly liable to scuffing of a member made of the material itself, during such frictional wear against another member, or to scuffing of said cooperating member. And this composite material has good anti burning characteristics, and thus is suitable for manufacturing electrical contact members, especially ones which are to be required to function in extreme conditions. Further, this composite material is also particularly suitable for the manufacture of welding tips.

Additionally, according to various particular aspects of the present invention, as the copper or copper alloy matrix metal for the composite material of the present invention there may be selected pure copper or a copper alloy which has vastly superior electrical conductivity as compared to copper alloys which are conventionally used for the manufacture of electrical contact members; and in this case, as will become clear from the detailed explanations which are given later in this specification, according to the results of the experimental researches which have been performed by the inventors of the present invention, even when the volume proportion of the alumina-silica type reinforcing fibers is in a relatively small region, satisfactory wear resistance for the composite material according to the present invention can be assured, and thereby the amount of wear both on parts made of the present composite material and on mating or cooperating parts can be satisfactorily minimized, and machinability can be increased. Thereby, a composite material which is vastly superior as compared with conventional electrical contact materials both in its own wear resistance and also with regard to the amount of wear caused on a cooperating member against which it is in frictional contact is produced, and this composite material also has high electrical conductivity.

Alumina-silica type short fibers are generally classified into glass fibers, so called silica-alumina fibers, and alumina fibers. Of these types, glass fibers, which have an alumina content of 40% by weight or less, have a low heat resistance and lose their strength at a relatively low temperature, and accordingly, when these fibers are heated up to a high temperature such as a typical temperature which is necessary for them to be composited with copper alloy, the strength and hardness characteristics which were present when these glass fibers were kept in the amorphous state are deteriorated, and their nature as reinforcing fibers is worsened; thereby the effectiveness of the improvement obtained in the strength and wear resistance characteristics of the resulting composite material is lowered. Thus, in summary, these reinforcing fibers are not suitable as reinforcing material for composite materials whose matrix material is copper or a copper alloy. On the other hand, so called silica-alumina fibers, which have an alumina content of 40% by weight or more, and also substantially pure alumina fibers, have high heat resistance, and accordingly are not substantially deteriorated when they are heated up to a high temperature such as a typical temperature which is necessary for them to be composited with copper alloy, and the strength and hardness characteristics which are present when these fibers are in the room temperature state are not significantly deteriorated during such composition, and their nature as reinforcing fibers is not significantly worsened; thereby the effectiveness of the improvement obtained in the strength and wear resistance characteristics of the resulting composite material is not significantly lowered. Accordingly, it is determined that the alumina-silica fibers used as reinforcing fibers for the copper or copper alloy matrix material, in the present invention, should have an alumina content of 40% by weight or more, in other words should be so called silica-alumina fibers or should be alumina fibers. And in particular the use of alumina fibers which have a high proportion of alpha alumina, or which are substantially entirely made of alpha alumina, are preferred.

Now, in collections of such fibers, there always is inevitably included by virtue of their method of manufacture a quantity of non fibrous particles (or shot type particles) of various sizes. These non fibrous particles have a hardness Hv equal to 500 or more, and their typical size of a diameter of from some tens to some hundreds of microns is very much larger than the typical size of the diameter of the fibers, which is some few microns. Therefore, when a collection of fibers including such non fibrous particles is used as reinforcing material for a composite material, the workability is much deteriorated, and severe wear is liable to occur on a mating element which is in frictional contact with a member made out of the composite material. Further, these large non fibrous particles are liable to be the cause of damage such as scuffing, both to such a mating element, and to the part made out of the composite material itself, because, during such frictional rubbing, these non fibrous particles are quite likely to become detached from the matrix metal and to come loose to move within the space between the part and the mating element. Similar problems are likely to be caused during machining of a part made out of the composite material, with regard to wear on a machining tool therefor. Accordingly, in order to relieve this type of problem, according to the results of the experimental researches as will be detailed hereinafter, it is decided, in order to produce a composite material with acceptable frictional characteristics, that a criterion for the composite material according to the present invention should be that its reinforcing fiber mass should contain not more than 7% by weight of non fibrous particles and not more than 1% by weight of non fibrous particles with a diameter of greater than equal to 150 microns, which are the ones which particularly cause wear and scuffing, and preferably should contain not more than 4% by weight of such non fibrous particles and not more than 0.6% by weight of such non fibrous particles with a diameter of greater than equal to 150 microns.

Further, with regard to the volume proportion required for the reinforcing alumina-silica type fibers in the material of the present invention, in order to properly exploit the advantages of utilization of such alumina-silica fibers, and in order to obtain the advantages detailed above with respect to strength and wear characteristics and heat resistance and so on in the resulting composite material, according to the results of the experimental researches as will be detailed hereinafter, with respect to ordinary type alumina-silica type short fibers with a fiber diameter of 1.0 to 3.0 microns and with a fiber length of 30 microns to 10 mm, it is decided, in order to produce a composite material with acceptable wear resistance and with acceptable characteristics with regard to amount of wear on a mating member, that a criterion for the composite material according to the present invention should be that the fiber volume proportion of its reinforcing fiber mass should be between 0.5% and 30%, and more preferably should be between 1.0% and 25%. If the fiber volume proportion is less than about 0.5%, then the wear resistance of the resulting composite material becomes insufficient; but if on the other hand the fiber volume proportion is greater than about 30%, then again the wear resistance of the resulting composite material is insufficient, and also the wear amount on a mating member is increased. In fact, even further, in virtue of the desirability of maximizing the electrical conductivity of the composite material, it is considered to be desirable that the fiber volume proportion should, more preferably, be limited to about 10%.

Moreover, with regard to the orientations of the individual short fibers of the collection of alumina-silica short fibers as embedded in the matrix of copper or copper alloy metal, it is in theory desirable from the point of view of strength and so on that these fibers should be oriented completely at random, i.e. isotropically with respect to all three spatial dimensions—the x, y, and z axes. However, in practice, excluding the case in which a composite material including such reinforcing fibers is manufactured by the powder metallurgy method, it is difficult to thus align the short fibers randomly in three dimensions, and actually, for example with respect to an x-y-z coordinate frame, it generally occurs that the short fibers are aligned substantially randomly in the x and y directions but are at least somewhat layered in planes parallel to the x-y plane, in other words that the x and y components of their orientation are on average of substantially the same magnitude, while the average magnitude value of the z component of their orientation is substantially less than said average x and y component magnitude value. In a composite material with reinforcing short fibers arranged in such a layered structure, the wear resistances of sectional surfaces extending parallel to the z axis is slightly superior to the wear resistance of sectional surfaces which are perpendicular to said z axis, on account of the larger number of short fibers cut across their bodies at relatively large angles by said surfaces on average; and further the conductivity in directions perpendicular to the z axis is superior to the conductivity in the direction of the z axis. Therefore, in the case of a part manufactured from the composite material according to the present invention, if as usually occurs the reinforcing short fibers are layered as described above preferentially in planes parallel to the x-y plane, it is considered to be best for the part to be so aligned with respect to the piece of composite material from which it is manufactured that a surface of which particularly heavy demands are going to be made with respect to wear resistance and heat resistance should be aligned generally parallel to the z axis, and that a direction requiring superior electrical conductivity should be aligned generally perpendicularly to the z axis. In addition to these considerations, other governing factors are also that the strength and rigidity in a direction perpendicular to the z axis are superior to those in the direction of the z axis, and that the thermal expansion coefficient in a direction perpendicular to the z axis are superior to that in the direction of the z axis. Accordingly, in the use of the fiber reinforced material according to the present invention, it is considered to be desirable to so align a part to be manufactured with respect to the piece of composite material from which it is to be manufactured, as to make best utilization of these various characteristics, in the light of the particular use anticipated for the part.

BRIEF DESCRIPTION OF THE DRAWINGS

The present invention will now be shown and described with reference to the preferred embodiments thereof, and with reference to the illustrative drawings. It should be clearly understood, however, that the description of the embodiments, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings, like parts and spaces and so on are denoted by like reference symbols in the various figures thereof; in the description, spatial terms are to be everywhere understood in terms of the relevant figure; and:

DESCRIPTION OF THE PREFERRED EMBODIMENTS

The present invention will now be described with reference to the preferred embodiments thereof, and with reference to the appended drawings.

THE FIRST PREFERRED EMBODIMENT

Figure 3:
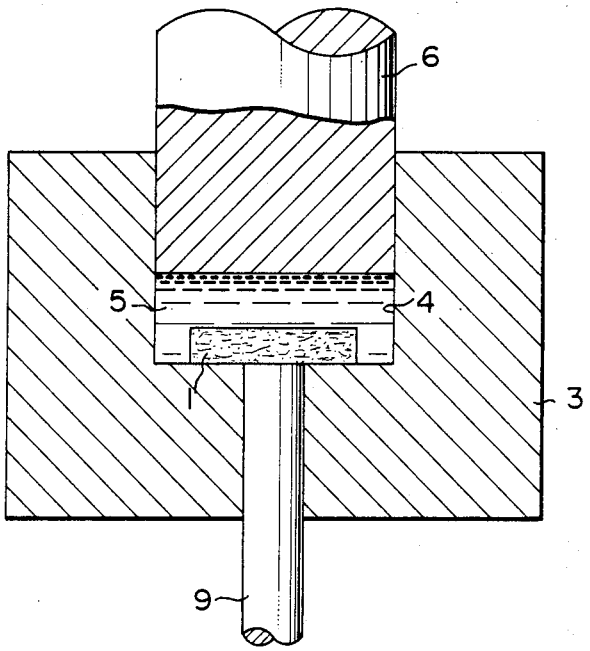
FIG. 3 is a schematic vertical sectional view taken through a high pressure casting device used for the manufacture of this first preferred embodiment.

Brass Matrix Metal With High Pressure Casting-Effect of Varying Included Particle Amount FIG. 3 is a schematic vertical sectional view taken through a high pressure casting device used for the manufacture of this first preferred embodiment. In this figure, the reference numeral 3 denotes a mold, which is formed with a mold cavity 4. A pressure piston 6 cooperates with this mold cavity 4 and is pressed downwards in the figure by a means, not shown, so as to apply pressure to a quantity 5 of molten metal which is being received in said mold cavity 4 as surrounding a preform 1 made of porous material previously placed in said mold cavity 4. When the quantity 5 of molten metal has solidified, the resulting cast piece is removed from the mold cavity 4, after the pressure piston 6 has been withdrawn, by the use of a knock out pin 9.

Using a high pressure casting device of the above type, brass was chosen as the matrix metal, and various types of reinforcing fibers were used as reinforcing material therefor, and samples were made as follows.

First, five masses of alumina-silica fibers of type "Kaowool" (this is a trademark) made by Isolite Babcock Taika KK and designated as A1 through A5, and four masses of alumina fibes of type "Saffil" (this is also a trademark) made by ICI KK and designated as B1 through B4, were prepared, and these nine fiber masses were subjected to per se known particle elimination processing to varying extents, so that the parameters of the resulting fiber masses were as shown in Table 1, which is given at the end of this specification and before the claims thereof. From this table, it will be seen that the "Saffil" fiber masses B1 through B4 had substantially no silica contained in them, and had a high percentage of the alpha alumina phase, while on the other hand the "Kaowool" fiber masses A1 through A4 had substantially none of the alpha alumina phase contained in them, and had a high percentage of silica; and within each set of fiber masses the only shown parameter that varied significantly was the weight percentage of large non fibrous particles with diameter greater than or equal to 150 microns.

Figure 2:
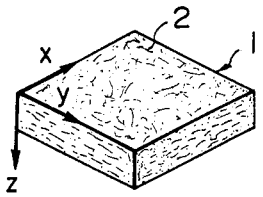
FIG. 2 is a perspective view of a preform made of fibers stuck together by a binder, for making the first preferred embodiment of the material according to the present invention.

Next, each of these masses of fibers was dispersed in colloidal silica, and the mixture was stirred up so that the mineral fibers therein were evenly dispersed, and then by the vacuum forming method a preform 1 of dimensions about 20 mm by about 80 mm by about 80 mm was formed, as shown in perspective view in FIG. 2. Each of these preforms 1 was then fired at a temperature of about 600° C., so that the silica was completely dried to hold together the individual fibers of said preform 1 by acting as a binder. In each case, the fibers of the preform 1 were oriented generally randomly and isotropically within planes parallel to the x-y plane in FIG. 2 (i.e. in planes parallel to the 80 mm by 80 mm surface of the preform 1), but lay preferentially in these planes, i.e. were stacked in layers in these planes.

Figure 4:
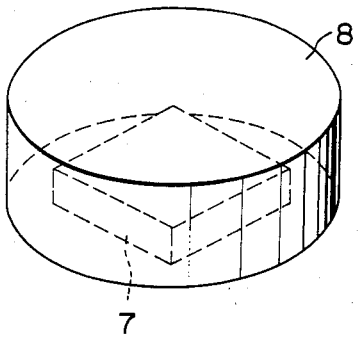
FIG. 4 is a perspective view of a cylindrical cast form made by the FIG. 3 apparatus, including a portion which includes said preform of FIG. 2 embedded in it, thus being composite fiber reinforced and being composed of said first preferred embodiment of the material according to the present invention.

Next, for each of these preforms 1, a casting process was performed, as schematically shown in section in FIG. 3. The preform 1 was placed into the mold cavity 4 of the casting mold 3 which itself was at this time heated up to a temperature of about 350° C., and then a quantity 3 of molten metal for serving as a matrix metal, in the case of this first preferred embodiment being molten brass of type JIS (Japanese Industrial Standard) YBsC2 and being heated up to a temperature of about 1080° C., was poured into the mold cavity 4 over and around the preform 1. Then the piston 6, which closely cooperated with the defining surface of the mold cavity 4, was forced into said mold cavity 4 and was forced inwards, so as to pressurize the molten brass metal mass 5 to a pressure of about 1500 kg/cm$^2$ and thus to force it into the interstices between the fibers making up the porous preform 1. The pressure of about 1500 kg/cm$^2$ was maintained until the mass 5 of molten brass metal was completely solidified, and then the resultant cast form was removed from the mold cavity 4 by the use of the knock out pin 9. This cast form is schematically shown in perspective view in FIG. 4, therein being denoted by the reference numeral 8. Finally, the part of this cast form 8 which consisted only of brass metal was machined away, and from the part 7 of said cast form 8 in which the porous preform 1 had been embedded was cut a cuboidal composite material test piece of brass metal with fibers dispersed throughout it for reinforcement.

From each of these cast forms 8 there was then cut a friction wear test sample. Now, during this cutting process, the cast forms 8 were each subjected to approximately the same amount of machining, under the same conditions: a super hard tool was used, with the coolant being water, and the cutting speed was 130 m/min while the feed rate was 0.03 mm per cycle. The amount of wear on the flank of the super hard cutting tool was measured in each case, and FIG. 5, which is a bar chart showing amount of wear in millimeters on said cutting tool flank on the vertical direction, shows the results of these cutting tool wear measurements for each of the cast forms made from the preforms A1 through A5 and B1 through B4.

Figure 5:
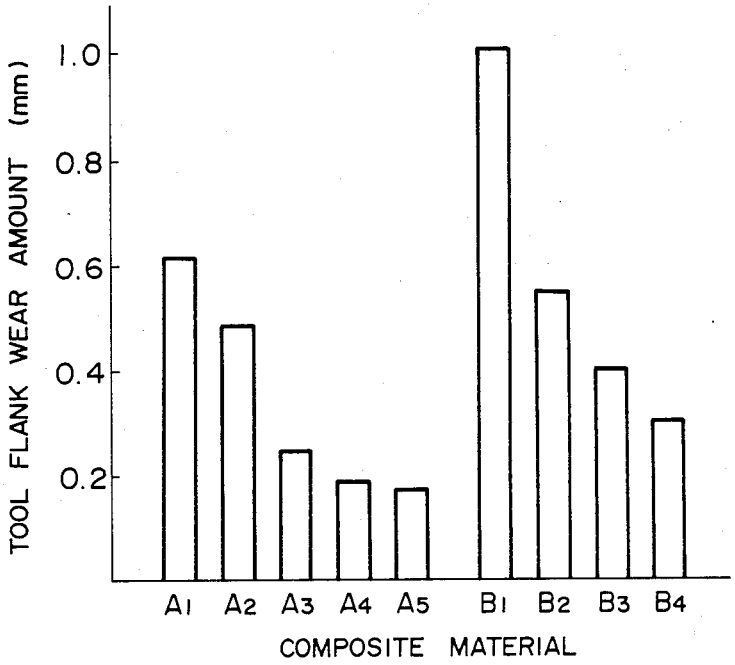
FIG. 5 is a bar chart showing in the vertical direction, for each of nine fiber preforms A1 through A5 and B1 through B4 of the FIG. 2 type, the amount of wear in millimeters on a cutting tool flank that occurred during a machining process of the cast form like that of FIG. 4 made from said preform.

From FIG. 5, it will be understood that the composite materials made from the preforms A1 and A2, and B1 and B2, in which the included amount of non fibrous particles was relatively large, and the included amount of non fibrous particles with diameter greater than or equal to 150 microns was also relatively large, had much poorer machinability than did the other composite materials, made from the preforms A3 through A5, and B3 and B4. Accordingly from these results it is decided, in order to produce a composite material with acceptable machinability, that a criterion for the composite material according to the present invention should be that its reinforcing fiber mass should contain not more than 7% by weight of non fibrous particles and not more than 1% by weight of non fibrous particles with a diameter of greater than equal to 150 microns, and preferably should contain not more than 4% by weight of non fibrous particles and not more than 0.6% by weight of non fibrous particles with a diameter of greater than equal to 150 microns.

Next, tests were performed in a LFW-1 friction wear test machine on the thus machined friction wear test samples made from the composite materials made from the preforms A1 and B1, in which the included amount of non fibrous particles was relatively large and the included amount of non fibrous particles with diameter greater than or equal to 150 microns was also relatively large, and on the thus machined friction wear test samples made from the composite materials made from the preforms A4 and B4, in which the included amount of non fibrous particles was relatively small and the included amount of non fibrous particles with diameter greater than or equal to 150 microns was also relatively small, as well as for comparison purposes on a similar wear test sample C made from pure brass of JIS (Japanese Industrial Standard) YBsC2 only. In each of these tests, a face of the wear test sample corresponding to the x-z plane as seen in FIG. 2 of the preform 2 included therein was brought into contact with the outer surface of a cylindrical test sample of steel of type JIS (Japanese Industrial Standard) SUJ2, and, while supplying lubricating oil of type Castle Motor Oil (this is a trademark) 5W-30 at room temperature of about 20° C. to the contacting surfaces of the test pieces, a sliding wear test was carried out by rotating the cylindrical test piece for one hour, using a contact pressure of 20 kg/mm$^2$ and a relative sliding speed of 0.3 m/sec.

Figure 6:
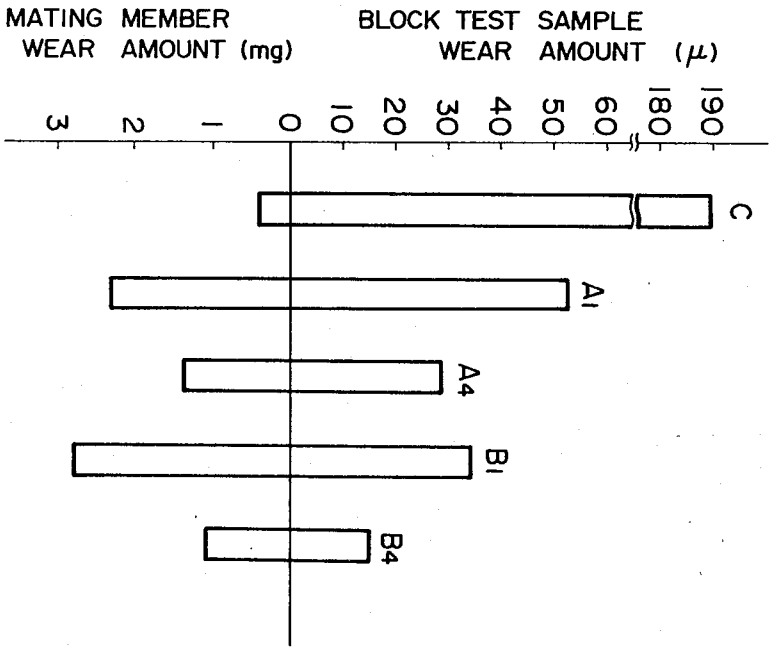
FIG. 6 is a bar chart showing in the vertical direction, for each of four wear test samples made from cylindrical cast forms of the FIG. 4 type made from the aforementioned four fiber preforms A1, A4, B1, and B4 of the FIG. 2 type, and also for a control wear test sample made of pure brass only, above the horizontal axis the amount of wear on the wear test sample itself in microns, and below the horizontal axis the amount of wear on a mating member in milligrams.

FIG. 6 shows the results of these friction wear tests. Above the horizontal axis in FIG. 6, there is shown the amount of wear on the wear test sample itself in microns, and below the horizontal axis there is shown the amount of wear on the stainless steel mating member in milligrams. From these wear test results, the following conclusions can be drawn. First, in the case of all the fiber reinforced materials A1, A4, B1, and B4, i.e. both for those (A1 and A4) which contained alumina-silica type fibers and for those (B1 and B4) which contained fibers made substantially of alumina only, the wear amount on the material itself was very much less than the wear amount on the test sample piece made only of brass without any reinforcing fiber material. Further, in the case of the friction wear test samples made from the fiber reinforced materials A1 and B1, in which the included amount of non fibrous particles was relatively large and the included amount of non fibrous particles with diameter greater than or equal to 150 microns was also relatively large, not only were the wear amounts of the composite materials themselves relatively high, as compared with the friction wear test samples made from the fiber reinforced materials made from the preforms A4 and B4, in which the included amount of non fibrous particles was relatively small and the included amount of non fibrous particles with diameter greater than or equal to 150 microns was also relatively small, but also the wear amounts on the mating stainless steel member were also relatively high. It was also confirmed that, in the case of the test sample made from the fiber reinforced material piece B1 which utilized as reinforcing material alumina fibers with relatively high included amount of non fibrous particles and relatively high amount of non fibrous particles of diameter greater than or equal to 150 microns, a large number of scuff marks were generated, both on the friction test sample B1 itself, and also along the peripheral direction of the cylindrical stainless steel mating member which had been rubbed against it. It is believed that the reason for these results is that, during this friction wear test, in the case of the friction wear test samples made from the fiber reinforced materials A1 and B1 in which the included amount of non fibrous particles was relatively large and the included amount of non fibrous particles with diameter greater than or equal to 150 microns was also relatively large, a number of the non fibrous particles became detached from the composite material wear test sample piece, and increased the wear amounts both of said composite material test piece and also of the mating stainless steel member, and also caused scuffing of both of these in the case of the wear test sample B1. Therefore again it is decided from these results, in order to produce a composite material with acceptable wear resistance and with acceptable characteristics with regard to amount of wear on a mating member, that a criterion for the composite material according to the present invention should be that its reinforcing fiber mass should contain not more than 7% by weight of non fibrous particles and not more than 1% by weight of non fibrous particles with a diameter of greater than equal to 150 microns, and preferably should contain not more than 4% by weight of non fibrous particles and not more than 0.6% by weight of non fibrous particles with a diameter of greater than equal to 150 microns.

THE SECOND PREFERRED EMBODIMENT

Bronze Matrix Metal With Sintering-Effect of Varying Fiber Volume Proportion Next, bronze was chosen as the matrix metal, and various types of reinforcing fibers were used as reinforcing material therefor, and samples were made as follows.

First, a quantity of alumina-silica fibers of type "Kaowool" (this is a trademark) made by Isolite Babcock Taika KK, and a quantity of alumina fibes of type "Saffil" (this is also a trademark) made by ICI KK, and also a quantity of alpha alumina type alumina fibers of type "Fiber FP" (this is also a trademark) made by DuPont, were prepared, and these three fiber quantities were subjected to per se known particle elimination processing, so that their parameters were as follows: the "Kaowool" alumina-silica fibers had total amount of included non fibrous particles of about 1.0% by weight and amount of included non fibrous particles of diameter greater than or equal to about 150 microns of about 0.1% by weight; the "Saffil" alumina fibers had total amount of included non fibrous particles of about 1.3% by weight and amount of included non fibrous particles of diameter greater than or equal to about 150 microns of about 0.1% by weight; and the "Fiber FP" alpha alumina type fibers had total amount of included non fibrous particles and amount of included non fibrous particles of diameter greater than or equal to about 150 microns both substantially equal to zero. The average length of the "Fiber FP" alpha alumina type fibers was about 3 mm. Other parameters of these fibers are shown in Table 2, which is given at the end of this specification and before the claims thereof.

Next, quantities of each of these masses of fibers were dispersed in ethanol; in detail, five quantities designated as A6 through A10 of the "Kaowool" fibers were thus prepared, seven quantities designated as B5 through B11 of the "Saffil" fibers were prepared, and one quantity designated as D of the "Fiber FP" fibers was prepared; and the amount used of the fibers in each case was such as to be appropriate for producing the respective fiber volume proportions as shown in Table 2. In each case, the mixture was stirred up so that the mineral fibers therein were evenly dispersed, and then the reinforcing fibers were separated in a stirrer for about 5 minutes. Next powdered bronze, of composition about 10% by weight of Sn and the remainder substantially Cu and with average particle diameter of about 20 microns, was added to each of the fiber collections, producing the respective fiber volume proportions as shown in Table 2; and the mixture was mixed in a mixer agitator for about 30 minutes. Next, in each case, the mixture was dried at a temperature of approximately 80° C. for about 5 hours, and then a suitable amount thereof was packed into a mold which had a mold cavity with cross sectional dimensions about 15.02 mm by 6.52 mm, and a pressure of about 4000 kg/cm$^2$ was applied thereto by a pressure punch, thus forming a block. Each of these blocks was then sintered for about 30 minutes in a batch type sintering furnace which was heated up to a temperature of about 770° C. in an atmosphere of decomposition ammonia gas (with dew point about −30° C.), and was then cooled slowly in a cooling zone of the sintering furnace. In this way, thirteen blocks of composite material were formed, and then friction wear test samples, respectively designated by the reference symbols A6 through A10 and B5 through B11 and D of their parent powders as shown in Table 2, were cut from each of them. And, for each of these thirteen blocks, a friction wear test was carried out in the same conditions as in the case of the first preferred embodiment of the present invention described above, with the face of the test sample piece which was parallel to the x-z plane in FIG. 2 being the one which was tested.

Figure 1:
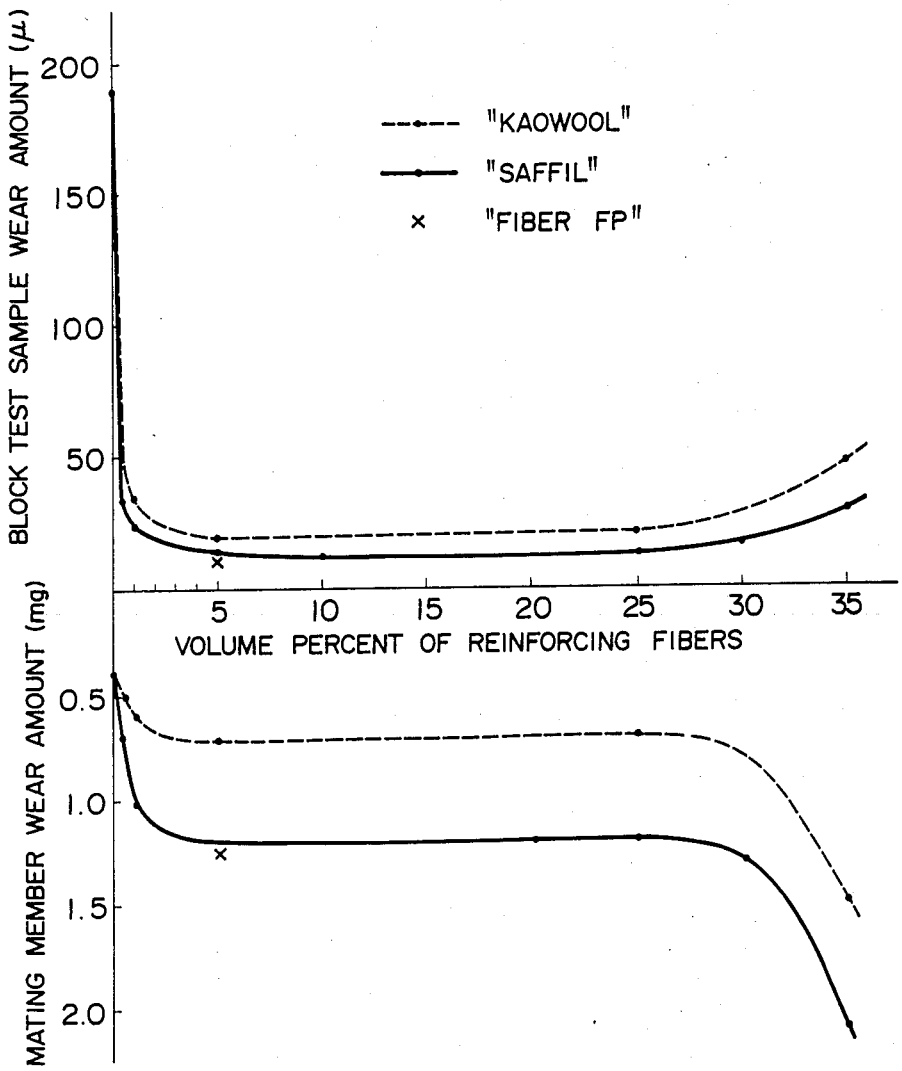
FIG. 1 is a set of graphs, showing the results of friction wear tests on certain composite material samples relating to the second preferred embodiment of the present invention, and showing above the horizontal axis the amount of wear on the wear test sample itself in microns and below the horizontal axis the amount of wear on a stainless steel mating member in milligrams, the dashed lines in this figure relating to samples including "Kaowool" type alumina-silica reinforcing fibers, while the solid lines relate to samples including "Saffil" type alumina reinforcing fibers and the two crosses relate to a lone sample including "Fiber FP" type alpha alumina reinforcing fibers.

FIG. 1 shows in the form of graphs the results of these friction wear tests. Above the horizontal axis in FIG. 1, there is shown the amount of wear on the wear test sample itself in microns, and below the horizontal axis there is shown the amount of wear on the stainless steel mating member in milligrams; and the dashed lines relate to the "Kaowool" alumina-silica fiber samples, while the solid lines relate to the "Saffil" alumina fiber samples and the two crosses relate to the lone "Fiber FP" alpha alumina fiber sample. From these wear test results, the following conclusions can be drawn. First, in the case both for those fiber reinforced materials which contained alumina-silica type fibers and for those which contained fibers made substantially of alumina only, even if the amount of reinforcing fiber material was relatively slight, the wear amount on the material itself was very much less than the wear amount on the test sample piece made only of bronze without any reinforcing fiber material. Accordingly, the benefits of reinforcement by even a small amount of fiber material containing alumina are made very clearly manifest. Further, it is seen that above a fiber volume proportion of about 30% the amount of wear on the fiber reinforced material itself, as well as the amount of wear on the mating member, both become higher, as compared to a fiber volume proportion below this 30% figure. Therefore it is decided from these results, in order to produce a composite material with acceptable wear resistance and with acceptable characteristics with regard to amount of wear on a mating member, that a criterion for the composite material according to the present invention should be that the fiber volume proportion of its reinforcing fiber mass should be between 0.5% and 30%, and more preferably should be between 1.0% and 25%. Further, particularly in the case that the composite material of the present invention is to be used for example in an electrically conducting member which will be subject to mechanical sliding friction from another member, in view of the desirability of providing high electrical conductivity for the composite material of the present invention, it is desirable that the fiber volume proportion of its reinforcing fiber mass should be between 0.5% and 10%, and more preferably should be between 1.0% and 5%.

Although the results of the relevant tests are not shown herein in the interests of brevity of description, it was confirmed that the composite material according to the present invention manufactured in this embodiment was to a very large extent better in wear resistance and in wear characteristics as regards a mating member and had high electrical conductivity, in comparison with copper alloys highly esteemed in the current art for use in electrical contact members, such as: an alloy of 40% by weight of Zn with balance Cu, an alloy of 10% by weight of Sn with balance Cu, an alloy of 2.4% by weight of Be with balance Cu, an alloy of 60% by weight of Pd with balance Cu, and an alloy of 0.5% by weight Cr with balance Cu.

THE THIRD PREFERRED EMBODIMENT

Manufacture of a Welding Tip Using Alumina Fibers With Copper Matrix Metal

A quantity of pure copper powder (manufactured by Fukuda Kinzoku Hakufun KK, of nominal purity 99.9% by weight) with an average particle diameter of about 20 microns, and a quantity of alumina fibers of type "FP fiber" (this is a trademark) manufactured by DuPont, were combined so that the volume proportion of fibers was 5%; and the mixture was mixed in a mixture agitator for about 5 minutes. Next, the mixture was put into a graphite mold having a cylindrical cavity with an internal diameter of 50 mm, and this was mounted in a vacuum hot press and the pressure inside the vacuum hot press was reduced to $5\times10^{-3}$ torr. The mixture was then heated up to a temperature of about 930° C. over a period of about 40 minutes, and then was maintained at this temperature for about 5 minutes, so that it was certainly heated all the way through to its interior. Then, the mixture was pressurized by a punch to a pressure of about 200 kg/cm$^3$, and this pressure and temperature were maintained for a further period of about 5 minutes. The mixture was then cooled down as far as to a temperature of about 800° C. with the pressure being maintained, after which the pressure was released and the mixture was allowed to cool down further in a cooling chamber. From the resulting cylindrical piece of composite material there was then formed by machining a spot welding tip of diameter about 50 mm and height about 15 mm.

When this spot welding tip was tested, it was confirmed that the electrical conductivity (LACS) thereof was about 93%, which is far superior to the electrical conductivity value of 80% obtained in the case of a tip manufactured from Cr-Cu alloy (0.5% by weight of Cr, and the remainder substantially Cu). Further, the number of welds per one dressing obtained in the case of the welding tip thus manufactured according to the third preferred embodiment of the present invention was much greater than in the case of a tip manufactured from the abovementioned Cr-Cu alloy.

Thus in summary it is seen, according to the composite material described above, that the disadvantages outlined in the portion of this specification entitled "Background of the Invention" with respect to the prior art are overcome, and there is provided a composite material which has very good sliding characteristics, and which has good electrical conductivity, which can be substantially equal to that of copper and alloys of copper. This composite material according to the present invention has good characteristics with regard to wear on a member made of the material itself, during frictional wear against another cooperating member, and also has good characteristics with regard to wear on said cooperating member. Further, this composite material according to the present invention not particularly liable to scuffing of a member made of the material itself, during such frictional wear against another member, or to scuffing of said cooperating member. And this composite material according to the present invention further has good anti burning characteristics, and thus is suitable for manufacturing electrical contact members, especially ones which are to be required to function in extreme conditions. Further, this composite material according to the present invention is also particularly suitable for the manufacture of welding tips, as shown from the description of the third preferred embodiment of the present invention given above.

Although the present invention has been shown and described with reference to the preferred embodiments thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown preferred embodiments, or of the drawings, but solely by the scope of the appended claims, which follow after the Tables.

TABLE 1

| | "Kaowool" | | | | | "Saffil" | | | |
|---|---|---|---|---|---|---|---|---|---|
| | A1 | A2 | A3 | A4 | A5 | B1 | B2 | B3 | B4 |
| Total non fibrous particle amount (wt %) | 9.7 | 8.0 | 6.9 | 3.5 | 1.3 | 7.5 | 6.8 | 4.1 | 1.0 |
| Total amount of non fibrous particles of 150 microns and more (wt %) | 1.6 | 1.1 | 0.9 | 0.5 | 0.1 | 1.3 | 0.9 | 0.6 | 0.1 |
| Proportion of alumina (wt %) | | | 47.3 | | | | 95.2 | | |
| Proportion of silica (wt %) | | | 52.6 | | | | 4.8 | | |
| Fiber volume proportion (%) | | | 0.16 | | | | 0.13 | | |
| Average fiber diameter (microns) | | | 2.8 | | | | 3.4 | | |
| Proportion of alpha alumina (wt %) | | | — | | | | 35 | | |

TABLE 2

| | "Kaowool" | | | | | "Saffil" | | | | | | | "Fiber FP" |
|---|---|---|---|---|---|---|---|---|---|---|---|---|---|
| | A6 | A7 | A8 | A9 | A10 | B5 | B6 | B7 | B8 | B9 | B10 | B11 | D |
| Fiber volume proportion (%) | 0.5 | 1 | 5 | 25 | 35 | 0.5 | 1 | 5 | 10 | 25 | 30 | 35 | 5 |
| Total non fibrous particle amount (wt %) | | | 1.0 | | | | | | 1.3 | | | | 0 |
| Total amount of non fibrous particles of 150 microns and more (wt %) | | | 0.1 | | | | | | 0.1 | | | | 0 |
| Average fiber diameter (microns) | | | 3.4 | | | | | | 2.8 | | | | 25 |
| Proportion of alpha alumina (wt %) | | | — | | | | | | 35 | | | | 100 |

What is claimed is:

1. An electrical sliding contact element for transmitting electrical power between itself and a mating member under mutual sliding surface contact therebetween, comprising a composite material which is composed essentially of a matrix metal which is copper or an alloy thereof, and a reinforcing fiber material which is a collection of alumina-silica type short fibers arranged, as viewed in an X-Y-Z coordinate frame having a Z axis extending substantially parallel with a contact surface of said sliding surface contact, so as substantially to align randomly in planes layered in parallel to the X-Y plane of said X-Y-Z coordinate frame, said fibers including alumina in about 40% by weight or more, non-fibrous particles included in said collection of fibers amounting to about 7% by weight or less, the total amount of non-fibrous particles with a diameter greater than or equal to about 150 microns being less than or equal to about 1% by weight, and with the volume portion of said short fiber material being from about 0.5% to about 30%.

2. An electrical sliding contact element comprising the composite material of claim 1, wherein the volume proportion of said short fiber material is from about 1.0% to about 25%.

3. An electrical sliding contact element comprising the composite material of claim 1, wherein the volume proportion of said short fiber material is from about 0.5% to about 10%.

4. An electrical sliding contact element comprising the composite material of claim 1, wherein the volume proportion of said short fiber material is from about 1.0% to about 5%.

5. An electrical sliding contact element comprising the composite material of claim 1, wherein the total amount of non fibrous particles included in said collection of fibers is less than or equal to about 4% by weight.

6. An electrical sliding contact element comprising the composite material of claim 1, wherein the total amount of non fibrous particles with diameter greater than or equal to about 150 microns included in said collection of fibers is less than or equal to about 0.6% by weight.

7. An electrical sliding contact element comprising the composite material of claim 1, wherein the material for said reinforcing fibers is alumina-silica fibers containing a substantial amount of silica.

8. An electrical sliding contact element comprising the composite material of claim 1, wherein the material for said reinforcing fibers is a fiber material substantially made only of alumina.

9. An electrical sliding contact element comprising the composite material of claim 1, wherein the material for said reinforcing fibers is a fiber material containing a substantial amount of alpha alumina.

10. An electrical sliding contact element comprising the composite material of claim 1, wherein the material for said reinforcing fibers is a fiber material substantially consisting only of alpha alumina.

11. An electrical sliding contact element comprising the composite material of claim 1, wherein the material for said matrix metal is substantially pure copper.

12. An electrical sliding contact element comprising the composite material of claim 1, wherein the material for said matrix metal is brass.

13. An electrical sliding contact element comprising the composite material of claim 1, wherein the material for said matrix metal is bronze.

* * * * *